US009979111B2

(12) United States Patent
Yoshioka et al.

(10) Patent No.: US 9,979,111 B2
(45) Date of Patent: May 22, 2018

(54) FEMALE TERMINAL HAVING A LOCKING ARRANGEMENT FOR A CYLINDRICAL SPRING CONTACT

(71) Applicant: YAZAKI CORPORATION, Tokyo (JP)

(72) Inventors: Toshikazu Yoshioka, Shizuoka (JP); Yuya Yamada, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/021,242

(22) PCT Filed: Oct. 7, 2014

(86) PCT No.: PCT/JP2014/076866

§ 371 (c)(1),
(2) Date: Mar. 10, 2016

(87) PCT Pub. No.: WO2015/053295

PCT Pub. Date: Apr. 16, 2015

(65) Prior Publication Data

US 2016/0226171 A1 Aug. 4, 2016

(30) Foreign Application Priority Data

Oct. 7, 2013 (JP) ..... 2013-210432

(51) Int. Cl.
*H01R 13/187* (2006.01)
*H01R 13/11* (2006.01)
(Continued)

(52) U.S. Cl.
CPC ..... *H01R 13/111* (2013.01); *H01R 13/187* (2013.01); *H01R 4/184* (2013.01); *H01R 24/20* (2013.01); *H01R 2101/00* (2013.01)

(58) Field of Classification Search
CPC ..... H01R 13/15; H01R 13/187
(Continued)

(56) References Cited

U.S. PATENT DOCUMENTS 4,657,335 A * 4/1987 Koch ..... H01R 13/187 439/851
5,203,803 A * 4/1993 Schoenmeyr ..... B01D 61/10 137/512.2
(Continued)

FOREIGN PATENT DOCUMENTS

JP 62-271374 A 11/1987
JP 11-67310 A 3/1999
(Continued)

OTHER PUBLICATIONS

English language Written Opinion of the International Search Report for PCT/JP2014/076866 dated Jan. 13, 2015.
(Continued)

*Primary Examiner* — Vanessa Girardi
(74) *Attorney, Agent, or Firm* — Kenealy Vaidya LLP

(57) ABSTRACT

A locking part (13S) which is formed in an end part of a male terminal insertion side of a spring contact is fixed to a fixing part (11S) which is formed in an end part of a female terminal main body (11), and in this state, a joint (11T) at which one end surface and the other end surface which are positioned in a circumferential direction of the female terminal main body face each other, and a joint (T) at which one end surface and the other end surface which are positioned in a circumferential direction of a spring contact (13) each other, are positioned to overlap each other in a radial direction.

6 Claims, 6 Drawing Sheets

(51) Int. Cl.
*H01R 4/18* (2006.01)
*H01R 24/20* (2011.01)
*H01R 101/00* (2006.01)

(58) Field of Classification Search
USPC ..... 439/843, 851
See application file for complete search history.

(56) References Cited

U.S. PATENT DOCUMENTS

| | | | | |
|---|---|---|---|---|
| 5,730,628 | A | 3/1998 | Hawkins | |
| 6,042,432 | A * | 3/2000 | Hashizawa | H01R 13/187 439/843 |
| 6,254,439 | B1 | 7/2001 | Endo et al. | |
| 6,837,756 | B2 * | 1/2005 | Swearingen | H01R 4/4881 439/843 |
| 7,387,532 | B1 | 6/2008 | Mao | |
| 8,959,763 | B2 * | 2/2015 | Wu | H01R 13/187 29/876 |
| 9,455,514 | B2 * | 9/2016 | Hirakawa | H01R 13/02 |
| 2001/0014560 | A1 | 8/2001 | Daugherty et al. | |
| 2002/0037674 | A1 * | 3/2002 | LaCoy | H01R 13/111 439/851 |
| 2012/0184158 | A1 | 7/2012 | Mounier et al. | |

FOREIGN PATENT DOCUMENTS

| | | | |
|---|---|---|---|
| JP | 2000-91013 | A | 3/2000 |
| JP | 3498832 | B2 | 2/2004 |
| JP | 2013-187171 | A | 9/2013 |
| WO | 2013/110303 | A1 | 8/2013 |

OTHER PUBLICATIONS

International Search Report and Written Opinion of the International Search Report for PCT/JP2014/076866 dated Jan. 13, 2015.

* cited by examiner (A)

(B)

(A)

(B)

(A)

(B)

FEMALE TERMINAL HAVING A LOCKING ARRANGEMENT FOR A CYLINDRICAL SPRING CONTACT

TECHNICAL FIELD

The present invention relates to a female terminal used in a connector which is used in connecting various types of machines loaded in an electric vehicle or a hybrid vehicle, and particularly to a female terminal in which a cylindrical spring contact which comes into contact with the corresponding male terminal is provided in a terminal main body.

BACKGROUND ART

As a female terminal in the related art, a female terminal described in Patent literature 1 is known. FIG. 4(A) is a perspective view of a female terminal described in Patent literature 1, and FIG. 4(B) is a longitudinal sectional view cut along an axial direction of the female terminal of FIG. 4(A). FIG. 5 is an exploded perspective view of the female terminal of FIG. 4(A).

In FIG. 4(A), a female terminal 100 is made of a female terminal main body 110, a cap 120, and a spring contact 130. Both the female terminal main body 110 and the spring contact 130 are formed by punching a metal plate, and the female terminal main body 110 is formed to be rounded in a cylindrical shape by press working. The cap 120 is formed by a synthetic resin by injection molding.

Hereinafter, the female terminal main body 110, the cap 120, and the spring contact 130 will be simply described.

As illustrated in FIG. 4(B), in the female terminal main body 110, a cap locking part 110A, a spring accommodation part 110B, a spring stopper 110C, a convex part 110D, and a fastening part 110K are formed in order from a tip end side (male terminal insertion side: left side of the drawing).

In addition, the cap locking part 110A is formed at the furthest tip end of the female terminal main body 110, and an inner diameter of the cap locking part 110A is set to be slightly larger than the maximum outer diameter of the spring contact 130. An outer circumferential part which protrudes outward in a radial direction of the cap locking part 110A is formed as a locking projection which is meshed with a locking claw which is formed inside the cap 120.

An inner diameter of the spring accommodation part 110B is formed to be substantially equivalent to the maximum outer diameter of the spring contact 130, and the spring contact 130 is accommodated in the spring accommodation part 110B. The spring accommodation part 110B is formed to be rounded in a cylindrical shape by press working. Therefore, as illustrated in FIGS. 5 and 6, at a joint 110T (refer to FIGS. 5 and 6) at which one end surface and the other end surface oppose each other in a circumferential direction of the spring accommodation part 110B, generation of a slight void is unavoidable.

An inner diameter of the spring stopper 110C is formed to be smaller than an outer diameter of a linking part 130R of the spring contact 130. Therefore, as the linking part 130R abuts against the spring stopper 110C, the spring contact 130 accommodated in the spring accommodation part 110B is restricted not to be moved further rearward (in a direction of the fastening part 110K), and the spring contact 130 is prevented from falling out from a rear side of the female terminal main body 110.

The convex part 110D is formed in a circumferential direction of a trunk part of the female terminal main body 110, and an outer diameter of the convex part 110D becomes substantially equivalent to an outer diameter of the cap 120. Accordingly, as an inner diameter of a terminal accommodation chamber of a connector housing in which the female terminal 100 is accommodated becomes substantially equivalent to the outer diameter of the cap 120, when the female terminal 100 is accommodated in the terminal accommodation chamber of the connector housing, the convex part 110D of the female terminal main body 110 is pressurized to an inner circumferential surface of the terminal accommodation chamber, and inclination or rattling of the female terminal 100 is prevented.

The fastening part 110K is formed in a U shape when viewed from a front surface before connecting the female terminal 100 and an electric wire which is not illustrated to each other, and when connecting the female terminal and the electric wire, by placing a core wire of the electric wire in a U-shaped bottom part, and by fastening both U-shaped end parts to each other on the inside using a tool, the electric wire is compressed to the fastening part 110K. Accordingly, the electric wire and the female terminal main body 110 are electrically connected to each other.

As illustrated in FIG. 4(B), the cap 120 is formed mainly by integrating an inlet 120G, a stopper wall 120S, and an outer wall 120W by a synthetic resin.

The stopper wall 120S is linked to the inlet 120G, and has a cylindrical shape having an inner diameter which is equivalent to the inlet 120G and an outer diameter which is substantially equivalent to the inner diameter of the cap locking part 110A of the female terminal main body 110. When the cap 120 is attached to a tip end of the female terminal main body 110, the cap 120 is pressed to the cap locking part 110A of the female terminal main body 110, and at this time, on the stopper wall 120S, an end surface thereof abuts against the linking part 130R of the spring contact 130 in the spring accommodation part 110B, and the spring contact 130 is restricted not to be moved forward.

The outer wall 120W is integrally formed at an interval having a width which is the same as a thickness of the cap locking part 110A, on the outer side of the stopper wall 120S. At a lower end on an inner circumferential surface of the outer wall 120W, the locking claw which is meshed with the locking projection of the female terminal main body 110 protrudes.

In the spring contact 130, the metal plate is punched to be a perforated plate, in which both end parts of multiple long plate spring pieces 130L in which a center part is curved to the inner side (center side when being rounded in a cylindrical shape) in an arc shape, are respectively linked to each other by linking parts 130R and 130R, and is used to be rounded in a cylindrical shape.

Next, an assembling method of the female terminal 100 will be described.

First, both ends of the long plate spring piece 130L come into contact with each other so that both ends of both linking parts 130R and 130R of the spring contact 130 are linked to each other, and maintaining this state, without contracting the spring contact 130 in a diameter direction, the spring contact 130 is inserted into the spring accommodation part 110B of the female terminal main body 110. At this time, as illustrated in FIG. 6(B), the joint 110T at which one end surface and the other end surface in the circumferential direction of the spring accommodation part 110B oppose each other, and a joint part where one end surface and the other end surface in the circumferential direction of the long plate spring piece 130L in the spring contact 130 oppose each other, are disposed to overlap each other in the radial direction. This is because performance as a point of contact deteriorates since the contact cannot be sufficiently ensured when the long plate spring piece 130L is disposed at the joint 110T of the spring accommodation part 110B.

After this, while pressing the stopper wall 120S of the cap 120 to the cap locking part 110A of the female terminal main body 110, the cap 120 is attached to the tip end of the female terminal main body 110.

At this time, an end surface of the stopper wall 120S which is pressed to the cap locking part 110A of the female terminal main body 110 abuts against the linking part 130R of the spring contact 130, and the spring contact 130 is held in the spring accommodation part 110B.

In addition, at the same time, the locking claw of the outer wall 120W is meshed with the locking projection on the outer circumference of the cap locking part 110A, and the cap 120 and the female terminal main body 110 are reliably integrated with each other.

Next, a problem of the female terminal 100 will be described by using FIG. 6.

FIG. 6(A) is a side view of the female terminal of FIG. 4(A), and FIG. 6(B) is a sectional view cut along arrow A-A in FIG. 6(A). In FIG. 6(B), at the joint 110T of the spring accommodation part 110B, there is a case where a void is generated between end surfaces in which one end surface and the other end surface oppose each other in the circumferential direction of the spring accommodation part 110B, or a case where a step is generated between the end surfaces in a case where the inner diameters of one end surface and the other end surface of the spring accommodation part 110B are different from each other. When the joint 110T and the long plate spring piece 130L overlap each other, since the contact between the joint 110T and the long plate spring piece 130L cannot be sufficiently ensured, the performance as a point of contact of the joint 110T deteriorates. Therefore, the long plate spring piece 130L which is at a position which overlaps the joint 110T is not considered as a point of contact.

Here, the long plate spring piece 130L is not disposed at the joint 110T, and work for disposing a void part T of the spring contact 130 is performed.

However, the spring contact 130 which is accommodated in the spring accommodation part 110B of the female terminal main body 110 is restricted not to be moved in an insertion direction of the terminal by the spring stopper 110C provided in the female terminal main body 110, and is restricted not to be moved in a disengaging direction of the terminal by the cap 120, but a structure in which the movement in a rotating direction is restricted is not provided.

Therefore, when any rotating force is applied to the spring contact 130, for example, the spring contact 130 rotates in an arrow direction R of FIG. 6(B), and as illustrated in FIGS. 6(B) to 6(C), a case where the void part T of the spring contact 130 is disengaged from the upper part of the joint 110T, and the regular long plate spring piece 130L is disposed on the joint 110T, can be generated.

However, since the performance of the long plate spring piece 130L on the joint 110T as a point of contact cannot be ensured, one spring becomes useless, and a case where all of the springs cannot be used as a point of contact is generated.

PATENT LITERATURE

[Patent literature 1] JP-B-3498832

SUMMARY OF INVENTION

Technical Problem

In consideration of solving the above-described problems, an object of the present invention is to provide a female terminal which can use all of the springs as a point of contact without disposing a regular spring on a joint.

Means for Solving the Problem

In order to solve the above-described problems, female terminals (1) to (4) according to the present invention have the following characteristics.

(1) A female terminal comprising:

a cylindrical female terminal main body including a male terminal accommodation space formed inside in an axial direction, and a cylindrical spring contact including a long plate spring piece accommodated in the male terminal accommodation space, wherein a locking part is fixed to a fixing part, wherein the locking part is formed at an end part of a male terminal insertion side of the spring contact, wherein the fixing part is formed in an end part of the male terminal insertion side of the female terminal main body, and wherein in this state, a joint at which one end surface and the other end surface which are positioned in a circumferential direction of the female terminal main body face each other, and a joint at which one end surface and the other end surface which are positioned in a circumferential direction of the spring contact face each other, are positioned to overlap each other in a radial direction.

(2) The female terminal according to claim 1, wherein the fixing parts are provided at a plurality of places, the locking parts are provided at a plurality of places, and each of the fixing parts and the locking parts are formed to be laterally asymmetrical.

(3) The female terminal according to claim 2, wherein the fixing part is a notch part configured to lock a spring bending part formed by notching the end part of the male terminal insertion side of the female terminal main body.

(4) The female terminal according to claim 3, wherein the locking part is a bending part formed by folding the end part of the male terminal insertion side of the spring contact on the outside.

Advantageous Effects of Invention

According to the above-described invention (1), since the long plate spring piece of the cylindrical spring contact is not disposed on the cylindrical joint of the female terminal main body, it is possible to efficiently use all of the springs as a point of contact.

According to the above-described invention (2), the fixing part and the locking part are respectively formed to be laterally asymmetrical. Therefore, when all of the locking parts are fixed to all of the fixing parts, since the void part of the joint of the spring contact is generated at the joint of the spring accommodation part, it is possible to prevent incorrect insertion of the spring contact into the female terminal main body.

According to the above-described invention (3), since the fixing part is formed by notching the end part of the female terminal main body, it is possible to simply make a reliable fixing part.

According to the above-described invention (4), since the locking part is formed by folding the end part of the male terminal insertion side of the spring contact to the outside, it is possible to simply make a reliable locking part.

DESCRIPTION OF EMBODIMENTS

Hereinafter, a female terminal of the present invention will be described based on FIGS. 1(A) to 3(B).

Figure 1:
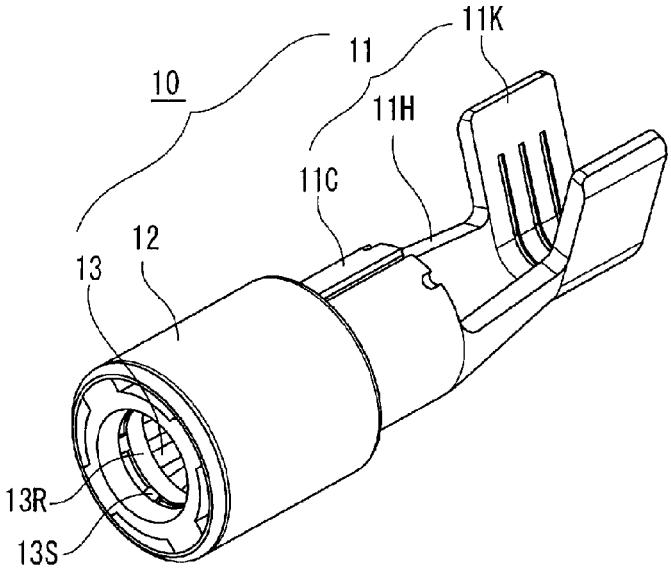
FIG. 1(A) is a perspective view of a female terminal according to the present invention.
FIG. 1(B) is a longitudinal sectional view cut along an axial direction of the female terminal of FIG. 1(A).
Figure 1:
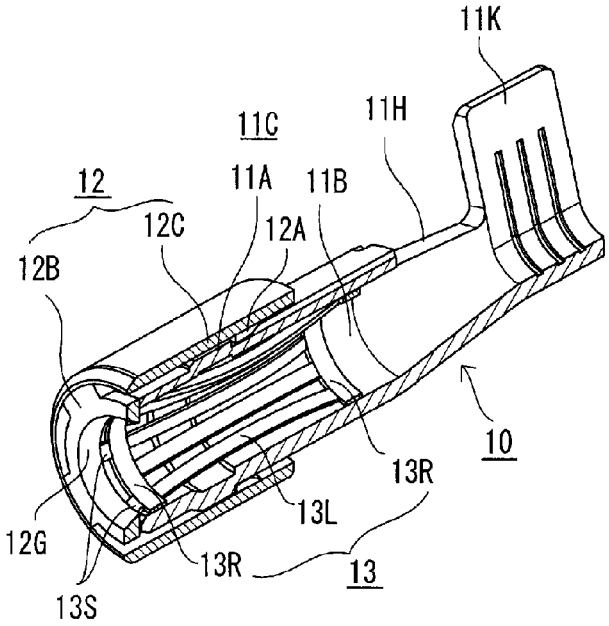
Figure 2:
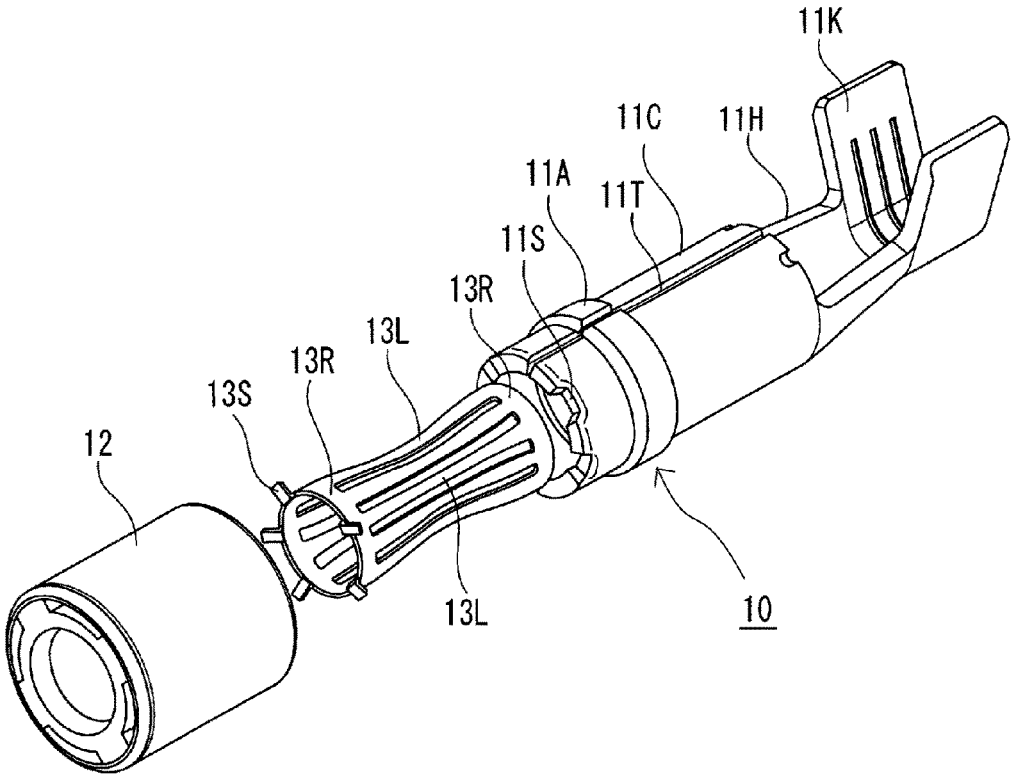
FIG. 2 is an exploded perspective view of the female terminal of FIG. 1(A).
Figure 3:
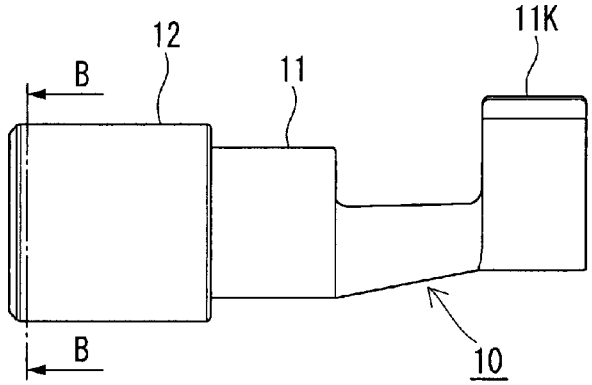
FIG. 3(A) is a side view of the female terminal of FIG. 1(A)
FIG. 3(B) is a sectional view cut along arrow B-B of FIG. 3(A).
Figure 3:
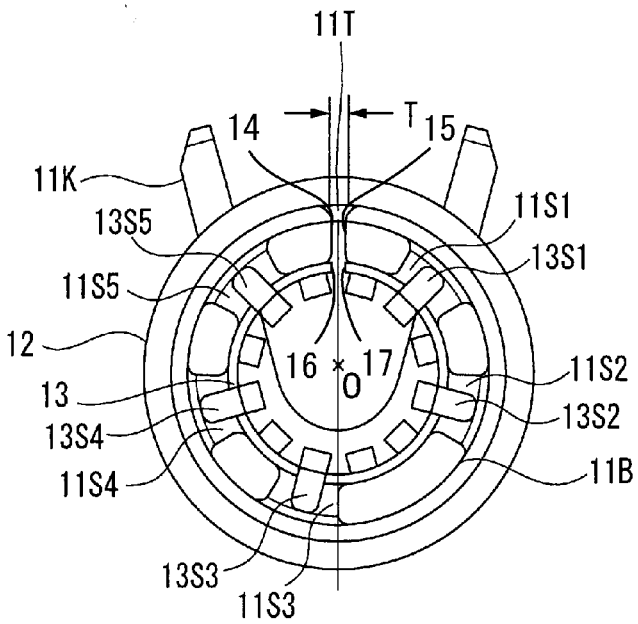
Figure 4:
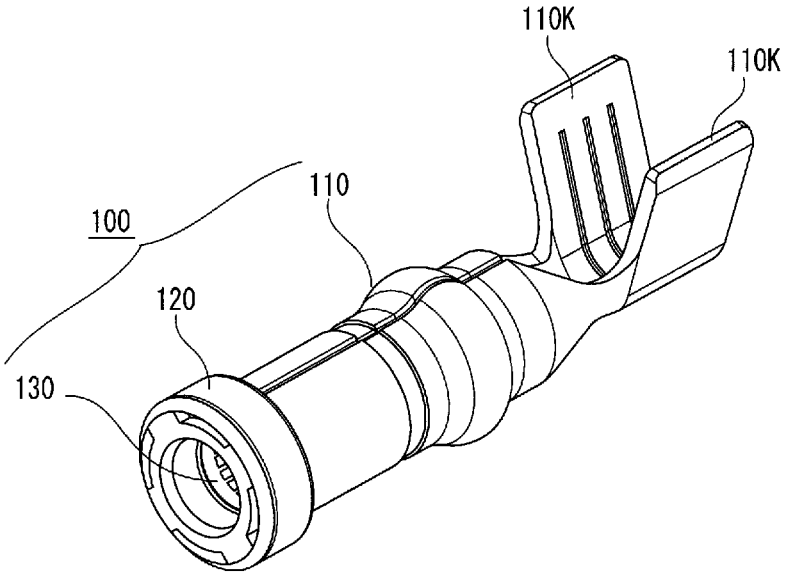
FIG.4 Prior Art
FIG. 4(A) is a perspective view of a female terminal described in Patent literature 1.
FIG. 4(B) is a longitudinal sectional view cut along an axial direction of the female terminal of FIG. 4(A).
Figure 4:
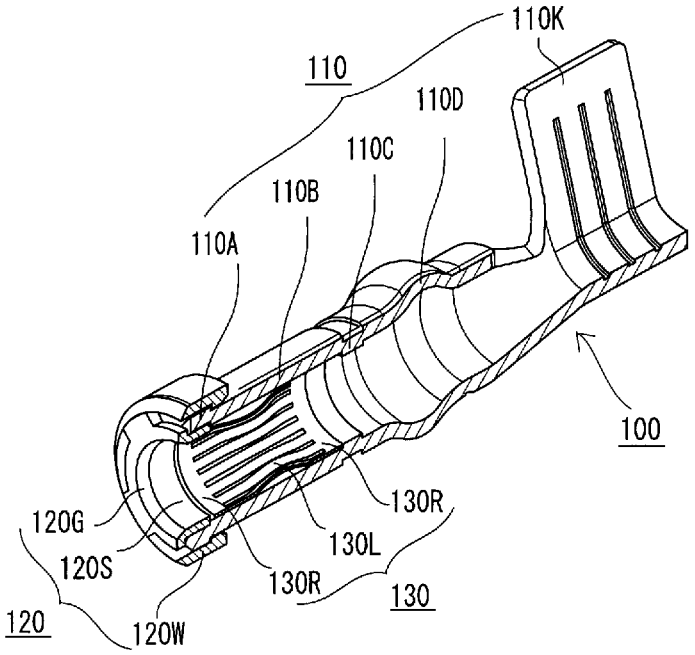
FIG.4 Prior Art
Figure 5:
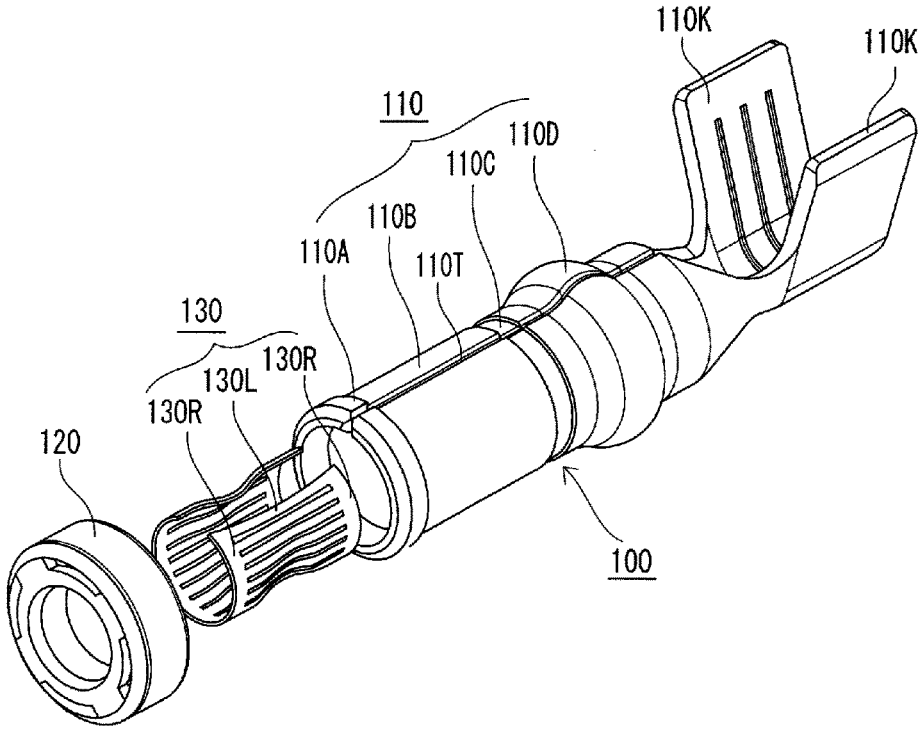
FIG.5 Prior Art
FIG. 5 is an exploded perspective view of the female terminal of FIG. 4(A).
Figure 6:
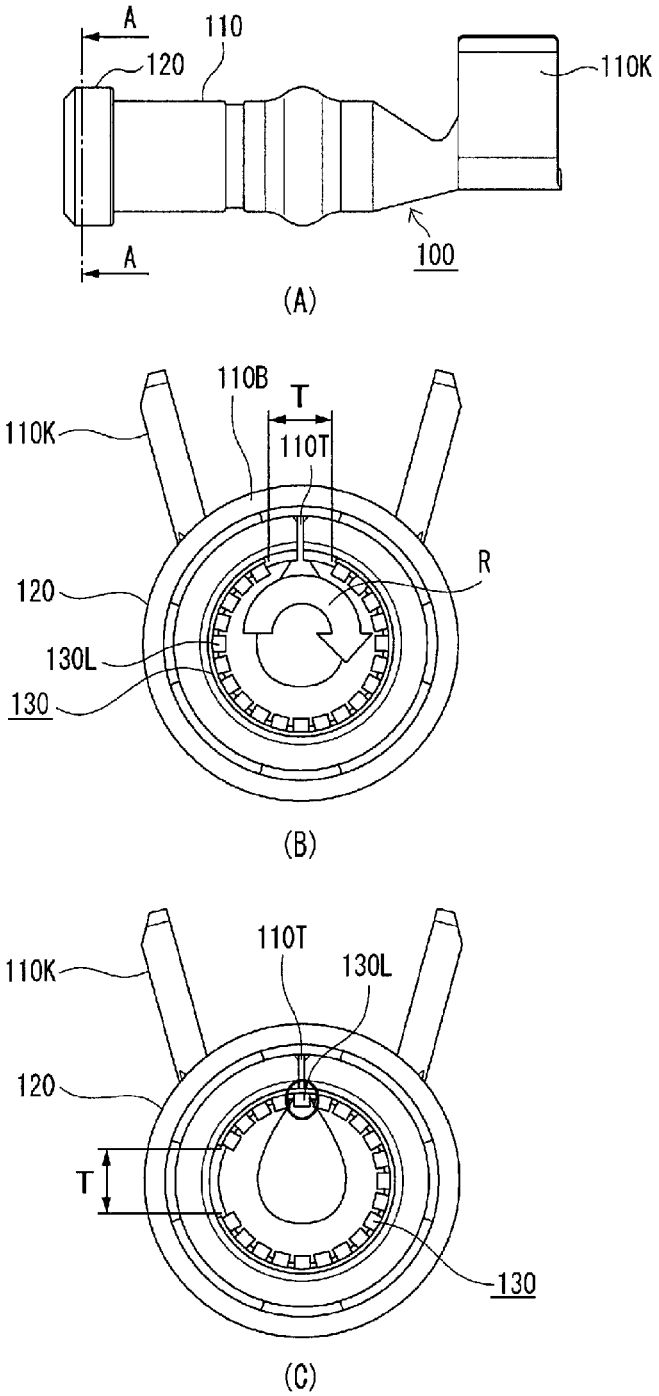
FIG.6 Prior Art
FIG. 6(A) is a side view of the female terminal of FIG. 4(A)
FIG. 6(B) is a sectional view cut along arrow A-A of FIG. 6(A)
FIG. 6(C) is a sectional view illustrating a state where a spring contact rotates in an arrow direction R of FIG. 6(B) and causes a defect.

FIG. 1(A) is a perspective view of the female terminal according to the present invention, and FIG. 1(B) is a longitudinal sectional view cut along an axial direction of the female terminal of FIG. 1(A). FIG. 2 is an exploded perspective view of the female terminal of FIG. 1(A).

In FIG. 1(A), a female terminal 10 is made of a female terminal main body 11, a resin cap 12, and a spring contact 13.

Both the female terminal main body 11 and the spring contact 13 are formed by punching a metal plate, and the female terminal main body 11 is formed to be rounded in a cylindrical shape by press working so that one end surface 14 and the other end surface 15 abut against each other. The resin cap 12 is formed by a synthetic resin by injection.

In addition, the spring contact 130 is formed to be rounded in a cylindrical shape so that one end surface 16 and the other end surface 17 abut against each other.

Hereinafter, the female terminal main body 11, the resin cap 12, and the spring contact 13 will be described in detail.

As illustrated in FIG. 1(A), the female terminal main body 11 is configured of a cylinder part 11C on a tip end side (male terminal insertion side: left side of the drawing), a fastening part 11K on a rear end side, and a semi-cylinder part 11H which links the cylinder part 11C and the fastening part 11K to each other.

As illustrated in FIG. 1(B), a spring accommodation part 11B which accommodates the spring contact 13 (refer to FIG. 2) in a cylindrical shape is formed inside the cylinder part 11C, a resin cap holding part 11A which stabilizes and holds the resin cap 12 is formed on an outer circumference, and spring bending part locking notches 11S (FIG. 2) which fix and support a bending part 13S (refer to FIG. 2) of the spring contact 13, are formed at a plurality of places in the male terminal insertion side end part.

As illustrated in FIG. 2, the resin cap holding part 11A is engaged with the resin cap 12 by an annular ring which has a predetermined thickness and has a predetermined width in the axial direction to the outside at substantially ⅓ from a front part (male terminal insertion side) of the cylinder part 11C.

The width of the annular ring in the axial direction is the width with which it is possible to stabilize and hold the resin cap 12 in the cylinder part 11C, and the thickness of the annular ring is substantially equivalent to the height of a locking claw 12A (FIG. 1(B)) formed on the inner side of the resin cap 12. A gentle taper is formed in the end part on the front side in the axial direction of the annular ring, and the resin cap 12 becomes easily fitted. In addition, a perpendicular cliff is formed in the end part on the rear side (in a direction of the fastening part 11K) of the annular ring, and the fitted resin cap 12 becomes unlikely to be easily detached.

As illustrated in FIG. 1(B), the spring accommodation part 11B has a cylindrical shape which accommodates the spring contact 13 in a cylindrical shape, and an inner diameter of the cylinder of the spring accommodation part 11B is substantially equivalent to the maximum outer diameter of the spring contact 13, and the depth of the cylinder of the spring accommodation part 11B is slightly longer than the entire length of the spring contact 13 in consideration of extension of the spring contact 13 when the male terminal which is not illustrated is inserted.

As illustrated in FIG. 2, the spring bending part locking notches 11S are notches which are respectively formed in the end part the male terminal insertion side in accordance with the bending parts 13S since the spring bending part locking notches 11S respectively lock the bending parts 13S of the spring contact 13. In the present invention, the parts where the spring bending part locking notches 11S are installed are designed as follows.

As illustrated in FIG. 3(B), in the cylinder part 11C, a joint 11T which is a void between one end surface 14 and the other end surface 15 which are positioned in the circumferential direction is formed, and five spring bending part locking notches 11S (refer to FIG. 2) including 11S1 to 11S6 are provided clockwise from a position which corresponds to the joint 11T (refer to FIG. 2) of the spring accommodation part 11B of the cylinder part 11C. In addition, each of bending parts 13S1 to 13S5 of the bending part 13S (refer to FIG. 2) of the spring contact 13 is locked to each of the spring bending part locking notches 11S1 to 11S5. In the drawing, in order to make it easy to understand, the spring bending part locking notches 11S1 to 11S5 are illustrated to be larger, and the bending parts 13S1 to 13S5 are illustrated to be smaller in the drawing, but in reality, the bending parts 13S1 to 13S5 do not have that much clearance in each of the bending part locking notch parts 11S1 to 11S5.

In addition, in the cylinder part 11C, by using a diameter which links the joint 11T which is a void formed between one end surface 14 and the other end surface 15 of the spring accommodation part 11B, and a cylinder center O as a center line, each of the bending part locking notch parts 11S1 to 11S5 becomes laterally asymmetrical, and accordingly, the bending parts 13S1 to 13S5 also become asymmetrical as a center line. In this manner, by making the parts asymmetrical, only the bending part 13S1 cannot be locked to the bending part locking notch part 11S1, and in this state, the void part T of the joint at which one end surface 16 and the other end surface 17 positioned in the circumferential direction of the spring contact 130 oppose each other, is disposed to overlap the joint 11T at which one end surface 14 and the other end surface 15 positioned in the circumferential direction of the spring accommodation part 11B, oppose each other in the radial direction of the center O.

Therefore, even if other bending parts 13S2 to 13S5 is engaged with the bending part locking notch part 11S1, since any of the other bending parts 13S2 to 13S5 cannot be locked to any of other bending part locking notch parts 11S2 to 11S5, incorrect insertion is prevented. In this manner, finally, the bending part 13S1 is locked to the bending part locking notch part 11S1, and accordingly, the void part T of the joint of one end surface 16 and the other end surface 17 of the spring contact 130 is disposed at the joint 11T of one end surface 14 and the other end surface 15 of the spring accommodation part 11B.

In this manner, when the bending part 13S1 is locked to the bending part locking notch part 11S1, since the movement of the terminal in the rotating direction is restricted, the terminal does not rotate even when a rotating force is applied to the spring contact 13 for some reason. Therefore, there is not a case where the void part T of the joint of the spring contact 130 is disengaged from the joint 11T of the female terminal, and the long plate spring piece 130L is placed onto the joint 11T of the female terminal. Accordingly, according to the present invention, there is not a case where one spring becomes useless, and all of the springs can be efficiently used as a point of contact.

As the bending part 13S of the spring contact 13 is locked to the spring bending part locking notch 11S, when the male terminal is inserted and comes into contact with the spring contact 13, the spring contact 13 makes the bending part 13S extend in a rearward direction (the direction of the fastening part 11K) as a fixing point. At this time, since a member which restricts the extension of the spring contact 13 rearward does not exist, the insertion force does not increase.

The fastening part 11K has a U-shape when viewed from a front view before fastening, and by placing a core wire of an electric wire in a U-shaped bottom part, and by fastening both U-shaped end parts to each other on the inside using a tool, the electric wire is compressed to the fastening part 11K, and the electric wire and the female terminal main body 11 are electrically connected to each other.

As illustrated in FIG. 1(A), the resin cap 12 is integrally formed in a bottomed cylindrical shape by a synthetic resin, an opening which is an inlet 12G of the male terminal is provided in a bottom part 12B, the locking claw 12A is provided on the inside of a cylinder part 12C.

An end part on the front side (male terminal insertion side) of the cylinder part 11C of the female terminal main body 11 abuts against the bottom part 12B. As the bottom part 12B and the end part of the cylinder part 11C abut against each other, the bending part 13S of the spring contact 13 locked to the spring bending part locking notch 11S is inhibited from being moved forward (male terminal insertion side).

Therefore, a spring falling prevention function when the terminal is disengaged and a lance locking function in a housing are achieved.

The inlet 12G has substantially the same diameter as that of the male terminal, and after attaching the resin cap 12 to the tip end of the female terminal main body 11, the male terminal is inserted into the female terminal main body 11 via the inlet 12G. By applying the taper to the inlet 12G, the tip end of the male terminal is smoothly guided into the inlet, and the male terminal is likely to be inserted into the female terminal main body 11.

As illustrated in FIG. 1(B), the height of the locking claw 12A is substantially equivalent to the thickness of the annular ring which is the resin cap holding part 11A (refer to FIG. 2) of the cylinder part 11C of the female terminal main body 11. A gentle taper is formed in the end part on the rear side (fastening part 11K), and the locking claw 12A is likely to be fitted to the resin cap holding part 11A of the female terminal main body 11, and additionally, a perpendicular cliff is formed in the end part on the front side (male terminal insertion side), and the fitted resin cap holding part 11A is not easily detached.

As illustrated in FIG. 1(B), in the spring contact 13, the metal plate is punched to be a perforated plate in which the multiple long plate spring pieces 13L which are gently curved to the inner side (center side when being rounded in a cylindrical shape) from both ends toward the center part in an arc shape are respectively linked to each other by linking parts 13R and 13R at both ends. While in use, the spring contact 13 is used being rounded in a cylindrical shape (refer to FIG. 2).

Furthermore, according to the present invention, the bending part 13S is formed by performing perpendicular bending from the end part of the linking part 13R on the front side (male terminal insertion side) of the spring contact 13 toward the outside in the radial direction. The bending part 13S is locked to the spring bending part locking notch 11S (refer to FIG. 2) which is formed in the end part of the male terminal insertion side of the cylinder part 11C of the female terminal main body 11.

Moreover, the bending part 13S is formed at a plurality of places (5 places in the drawing) as described above.

In other words, in FIG. 3(B), the bending parts 13S1 to 13S5 are formed clockwise from the joint 11T of the spring accommodation part 11B, and by using a diameter which links the joint 11T of the spring accommodation part 11B and the cylinder center O as a center line, each of the bending parts 13S1 to 13S5 becomes laterally asymmetrical in the drawing.

In this manner, by making the parts asymmetrical, since the bending part 13S1 is necessarily locked to the bending part locking notch part 11S1, the void part T of the joint of the spring contact 130 is disposed to the joint 11T of the spring accommodation part 11B.

Next, an assembling method of the above female terminal 10 will be described.

First, the spring contact 13 is rounded so that one end surface 16 and the other end surface 17 abut against each other, and is inserted into the spring accommodation part 11B of the female terminal main body 11 without contracting the spring contact 13 in the diameter direction.

At this time, if the void part T of the joint of the spring contact 130 is set to come to the joint 11T of the spring accommodation part 11B, all of the bending parts 13S can be locked to all of the notch parts 11S configured to lock the spring bending part. Accordingly, even when a force is applied to the spring contact 13 accommodated in the spring accommodation part 11B of the female terminal main body 11 in the rotating direction, the spring contact 13 is inhibited from being rotated.

After this, the resin cap 12 is inserted into the cylinder part 11C of the female terminal main body 11, the locking claw 12A of the resin cap 12 engages over the resin cap holding part 11A of the cylinder part 11C, the resin cap 12 and the cylinder part 11C are engaged with each other, and the resin cap 12 is engaged with the female terminal main body 11. Accordingly, the bending part 13S of the spring contact 13 accommodated in the spring accommodation part 11B of the female terminal main body 11 is locked to the notch part 11S configured to lock a spring bending part of the female terminal main body 11, and the bending part 13S is inhibited from being moved to the front side (male terminal insertion side) and the rear side (fastening part 11K side).

As described above, by using a diameter which links the joint part of the spring accommodation part and the cylinder center as a center line, each of the bending part locking notch parts and the bending parts becomes laterally asymmetrical in the drawing. For this reason, as all of the bending parts are locked to all of the bending part locking notch parts, since the void part of the joint of the spring contact is disposed at the joint of the spring accommodation part, the long plate spring piece of the spring contact is not disposed.

Therefore, according to the present invention, there is not a case where one spring becomes useless, and all of the springs can be efficiently used as a point of contact.

In addition, as the bending part of the spring contact is locked to the notch part configured to lock a spring bending part, when the male terminal is inserted and comes into contact with the spring contact, the spring contact extends to the rear side (direction of the fastening part) by using the bending part as a fixing point. Therefore, a repellent force of the spring contact is not generated, and thus, a negative effect that an insertion force of the male terminal is reduced is obtained.

As described above, each of the plurality of bending parts in which of the end part of the male terminal insertion side of the spring contact is folded to the outside, is fixed to the laterally asymmetrical notch formed in the end part of the female terminal main body, and in this state, the void part of the joint of the cylindrical spring contact is positioned on the joint of the cylinder of the female terminal main body. For this reason, the long plate spring piece of the spring contact is not disposed at the joint part of the spring accommodation part, and thus, there is no case where anyone spring becomes useless, and all of the springs can be efficiently used as a point of contact.

In addition, as a fixing part, in the embodiment, the notch which is formed by notching the end part of the female terminal main body is realized, but the present invention is not limited thereto, and a part which is fixed to the end part of the female terminal main body by a screw or a pin may be employed.

In addition, as a locking part, in the embodiment, the bending part in which the end part of the spring contact is folded to the outside is realized, but the present invention is not limited thereto, and a convex part which is formed to protrude to the outside from the inside in the end part of the spring contact, or a part which is fixed by inserting a screw from the outside to the end part of the spring contact, may be employed.

Here, each of the characteristics of the embodiment of the female terminal according to the above-described present invention will be listed being simply summarized in the following [1] to [4].

[1] A female terminal (10) comprising a cylindrical female terminal main body (11) including a male terminal accommodation space formed inside in an axial direction, and a cylindrical spring contact (13) including a long plate spring piece (13L) accommodated in the male terminal accommodation space, wherein a locking part (13S) is fixed to a fixing part (11S), wherein the locking part (13S) is formed at an end part of a male terminal insertion side of the spring contact, wherein the fixing part (11S) is formed in an end part of the male terminal insertion side of the female terminal main body, and wherein in this state, a joint (11T) at which one end surface (14) and the other end surface (15) which are positioned in a circumferential direction of the female terminal main body face each other, and a joint (T) at which one end surface (16) and the other end surface (17) which are positioned in a circumferential direction of the spring contact face each other, are positioned to overlap each other in a radial direction (radial direction of a center O).

[2] The female terminal according to the above-describe [1], wherein the fixing parts are provided at a plurality of places, the locking parts are provided at a plurality of places, and each of the fixing parts and the locking parts are formed to be laterally asymmetrical.

[3] The female terminal according to the above-described [2], wherein the fixing part is a notch part (11S) configured to lock a spring bending part which is formed by notching the end part of the male terminal insertion side of the female terminal main body.

[4] The female terminal according to the above-described [3], wherein the locking part is a bending part (13S) formed by folding the end part of the male terminal insertion side of the spring contact on the outside.

The present invention is described in detail with reference to a certain embodiment, but it is apparent for those skilled in the art that various changes or modifications are possible without departing from the spirit and the range of the present invention.

The present application is based on Japanese Patent Application No. 2013-210432 filed on Oct. 7, 2013, and the content thereof is incorporated herein by reference.

INDUSTRIAL APPLICABILITY

In the present invention, since the long plate spring piece of the cylindrical spring contact is not positioned on the joint of the cylinder of the female terminal main body, all of the springs can be efficiently used as a point of contact. The present invention which achieves the effects is advantageous in the field related to the female terminal in which the cylindrical spring contact which comes into contact with the corresponding male terminal is provided in the terminal main body.

REFERENCE SIGNS LIST

10 FEMALE TERMINAL
11 FEMALE TERMINAL MAIN BODY
11A RESIN CAP HOLDING PART
11B SPRING ACCOMMODATION PART
11C CYLINDER PART
11H SEMI-CYLINDER PART
11K FASTENING PART
11S NOTCH PART CONFIGURED TO LOCK SPRING BENDING PART
11T JOINT OF SPRING ACCOMMODATION PART
12 RESIN CAP
12A LOCKING CLAW
12B BOTTOM PART
12G INLET
13 SPRING CONTACT

13L LONG PLATE SPRING PIECE
13R LINKING PART
13S BENDING PART
T JOINT OF SPRING CONTACT

The invention claimed is:

1. A female terminal comprising:

a cylindrical female terminal main body including a male terminal accommodation space formed inside in an axial direction, and a cylindrical spring contact including a long plate spring piece and a plurality of locking parts accommodated in the male terminal accommodation space, wherein each locking part is formed only at one end that being a male terminal insertion side of the spring contact, wherein a plurality of fixing parts are formed only at one end that being a male terminal insertion side of the female terminal main body, wherein the plurality of locking parts are fixed to the plurality of fixing parts, and wherein the female terminal main body includes one end surface, an other end surface, and a joint at which the one end surface and the other end surface are positioned in a circumferential direction of the female terminal main body to face each other, the spring contact includes one end surface, an other end surface, and a joint at which the one end surface and the other end surface are positioned in a circumferential direction of the spring contact to face each other, and the joint of the female terminal main body and the joint of the spring contact are positioned to overlap each other in a radial direction, and wherein each one of the locking parts engages a respective one of the fixing parts only when the female terminal main body accommodates the spring contact in a predetermined rotational orientation relative to the female terminal main body, and engagement of each of the locking parts with the respective one of the fixing parts causes the female terminal main body joint and spring contact joint to overlap each other and maintains the joints in the position to overlap each other.

2. The female terminal according to claim 1, wherein the female terminal main body includes a fastening part that is configured to compress an electrical wire in the female terminal, and the fastening part has a U-shape when viewed from the end part of the male terminal insertion side of the female terminal main body.

3. The female terminal according to claim 1, wherein the female terminal main body includes:

a cylindrical part that includes a spring accommodation part that contains the spring contact;

a semi-cylinder part that extends from the cylindrical part; and a fastening part extending from the semi-cylinder part such that the semi-cylinder part is between the fastening part and the cylindrical part.

4. The female terminal according to claim 1, wherein each of the fixing parts and the locking parts are formed to be laterally asymmetrical with respect to a diameter of the female terminal main body that passes through the joints.

5. The female terminal according to claim 1, wherein at least one of the fixing parts is a notch part configured to lock a spring bending part formed by notching the end part of the male terminal insertion side of the female terminal main body.

6. The female terminal according to claim 3, wherein each locking part is a bending part formed by folding part of the male terminal insertion side of the spring contact to the outside.

* * * * *